US007121855B1

(12) United States Patent
Su

(10) Patent No.: US 7,121,855 B1
(45) Date of Patent: Oct. 17, 2006

(54) MODULARIZED SWITCH CONNECTOR

(76) Inventor: Benson Su, No. 17, Alley 11, Lane 225, Jia-Dong Rd., Sijhih City, Taipei Hsien (TW)

( * ) Notice: Subject to any disclaimer, the term of this patent is extended or adjusted under 35 U.S.C. 154(b) by 0 days.

(21) Appl. No.: 11/258,048

(22) Filed: Oct. 26, 2005

(51) Int. Cl.
*H01R 29/00* (2006.01)

(52) U.S. Cl. ..... 439/188; 200/82 C

(58) Field of Classification Search ..... 439/944, 439/626, 625, 224, 106, 101, 660, 374, 910, 439/597, 617, 638, 651, 655, 752, 954, 188; 200/51, 50.01, 50.27, 51.06, 51 R, 51.09, 200/82 C See application file for complete search history.

(56) References Cited

U.S. PATENT DOCUMENTS 5,662,484 A * 9/1997 Blanche ..... 439/106
5,959,843 A * 9/1999 Kurrer et al. ..... 361/754
6,767,226 B1 * 7/2004 Varatta ..... 439/106
6,802,741 B1 * 10/2004 Shatkin ..... 439/620
6,855,007 B1 * 2/2005 Irish et al. ..... 439/614
7,037,133 B1 * 5/2006 Matsuo ..... 439/606

* cited by examiner

*Primary Examiner*—Truc T. Nguyen
*Assistant Examiner*—Edwin A. Leon
(74) *Attorney, Agent, or Firm*—Troxell Law Office, PLLC

(57) ABSTRACT

A modularized switch connector having a shovel shaped insulating housing formed integrally, the housing is shaped in matching with the shape and contour surrounding a first and a second electrically connecting pin as well as a grounding electrically connecting pin of a micro switch. The housing is formed thereon a first and a second through hole, and is formed on its lower forwardly protruding portion a third through hole. The rear end of each hole allows inserting of an electrically conducting jack with a "U" shaped section therein. The front end of each through hole allows inserting of an electrically connecting pin of the micro switch; so that the first and the second electrically connecting pins of the micro switch can be connected with two electrically conducting jacks in the first and the second through holes, while the grounding electrically connecting pin can be connected with the electrically conducting jack in the third through hole.

3 Claims, 4 Drawing Sheets

MODULARIZED SWITCH CONNECTOR

BACKGROUND OF THE INVENTION

1. Field of the Invention

The present invention is related to a switch connector, and especially to a modularized switch connector with which electrically conducting jacks can all be electrically connected to a micro switch via the switch connector.

2. Description of the Prior Art

An electrically insulating switch connector is used for connecting to a micro switch and electrically conducting jacks, and to cover and protect their electrically conductive connecting areas. FIG. 1 depicts a micro switch 910 and a set of conventional switch connector 920.

The micro switch 910 has three electrically connecting pins extending out of it, wherein the first and the second electrically connecting pins 911 and 912 are provided at one end of the micro switch and parallel with each other, the third grounding electrically connecting pin 913 is extended out of the bottom of the micro switch 910.

The conventional switch connector 920 is composed of three rectangular housings 921 and three electrically conducting jacks 930. Each rectangular housing 921 is a hollow member with a through hole, thus the electrically conducting jacks 930 each with a "U" shaped section are fittingly assembled in the rectangular housings 921 respectively, front openings 922 on the front ends of the housings 921 accept insertion of the electrically connecting pins 911 to 913 of the micro switch 910, in order that the electrically conducting jacks 930 electrically contact with the electrically connecting pins 911 to 913 and their electrically conductive connecting areas are enveloped by the housings 921.

Such a conventional switch connector 920 is composed of the rectangular housings 921, it is supposed to make electric line connection one by one during the process of assembling, its working is inconvenient and is subjected to having a problem of wrongly inserting; the conventional switch connector 920 thereby needs to be improved.

SUMMARY OF THE INVENTION

The present invention mainly is to provide a modularized switch connector having a shovel shaped insulating housing formed integrally, the housing is shaped in matching with the shape and contour surrounding a first and a second electrically connecting pin as well as a grounding electrically connecting pin of a micro switch. The insulating housing is formed thereon a first and a second through hole, and is formed on its lower forwardly protruding portion a third through hole. The rear end of each of the through holes allows inserting of an electrically conducting jack with a "U" shaped section therein, while the front end of each through hole allows inserting of a corresponding electrically connecting pin of the micro switch; so that the first and the second electrically connecting pins of the micro switch can be connected with two electrically conducting jacks in the first and the second through holes, while the grounding electrically connecting pin can be connected with the electrically conducting jack in the third through hole.

The main object of the present invention is to provide a modularized switch connector having a shovel shaped insulating housing, the shovel shaped insulating housing endues us with a sense of direction, thereby in assembling, three electrically connecting pins of a micro switch can be simultaneously connected with three electrically conducting jacks, the assembling is easier than that for the conventional switch connector, and there will be no defect of wrongly inserting.

Moreover, the modularized switch connector of the present invention has two seats with holes integrally connected with and provided laterally of the modularized switch connector, the holes in the seats can be mounted respectively with two electrically conducting jacks for in turn connecting with indicating lamps.

The present invention will be apparent in its structural features and operational functions after reading the detailed description of the preferred embodiment thereof in reference to the accompanying drawings.

DETAILED DESCRIPTION OF THE PREFERRED EMBODIMENT

Figure 1:
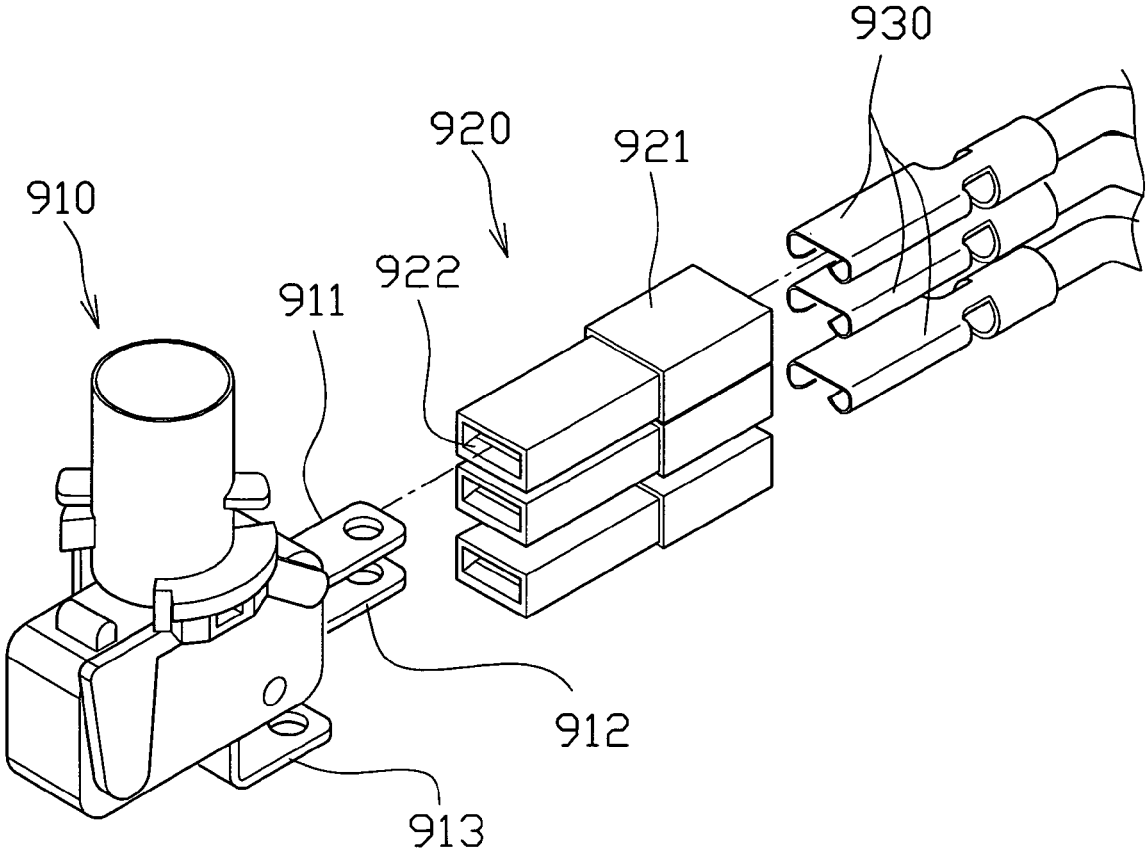
FIG.1 PRIOR ART
FIG. 1 is an anatomic perspective view showing a conventional switch connector and a micro switch.
Figure 2:
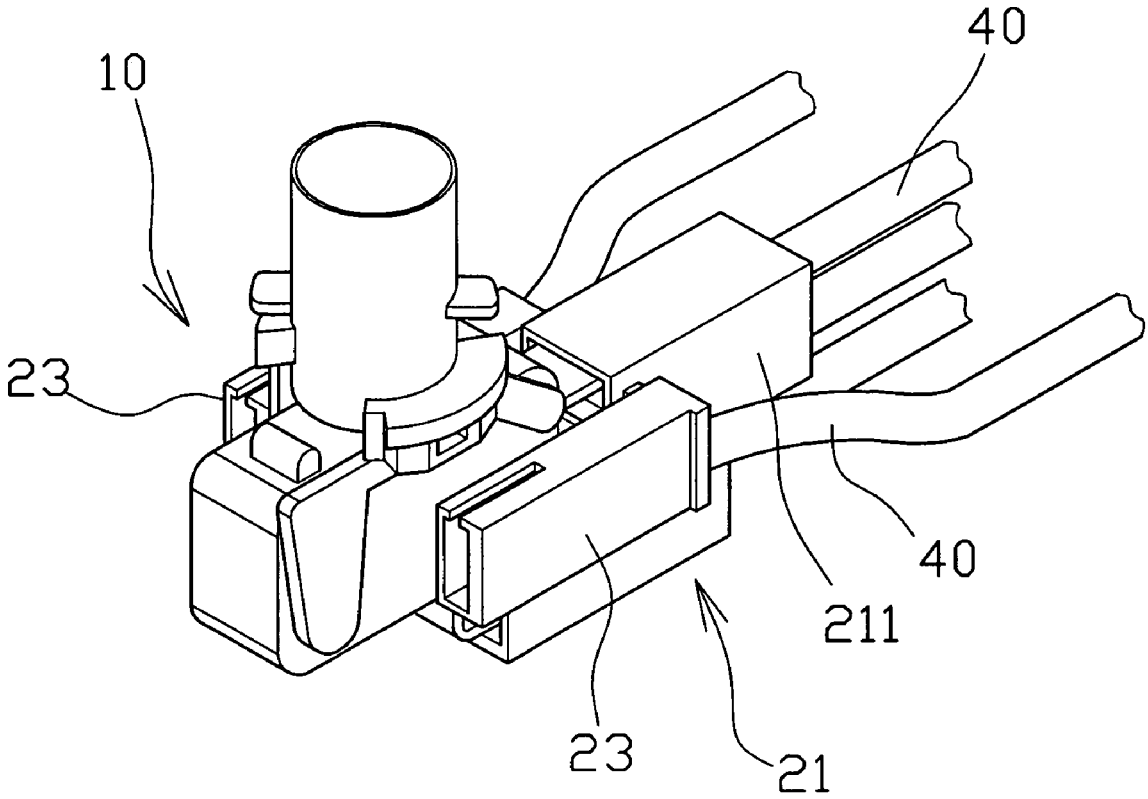
FIG. 2 is a perspective view showing the present invention and a micro switch.
Figure 3:
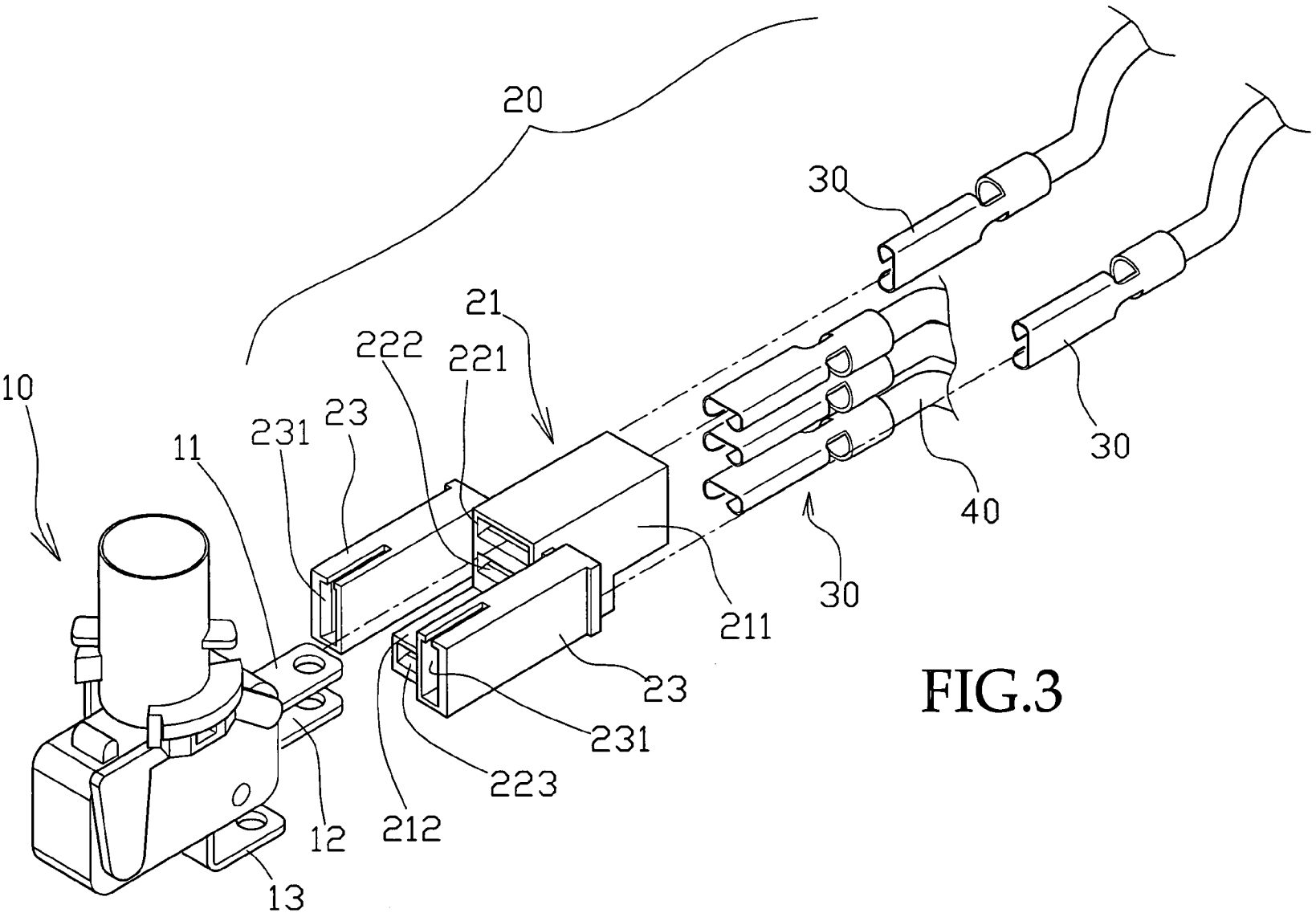
FIG. 3 is an anatomic perspective view showing the members of FIG. 2.

Referring to FIGS. 2 and 3, the present invention provides a novel modularized switch connector 20 used for connecting to electrically connecting pins of a micro switch 10.

The micro switch 10 has three electrically connecting pins extending out of it, wherein a first electrically connecting pin 11 and a second electrically connecting pin 12 are provided at one end of the micro switch and parallel with each other, and a third grounding electrically connecting pin 13 is extended out of the bottom of the micro switch 10.

The modularized switch connector 20 of the present invention has an insulating housing 21 mounted therein with plural electrically conducting jacks 30 with "U" shaped sections fittingly covering the electrically connecting pins of the micro switch 10 for electrically conducting, rear ends of the electrically conducting jacks 30 are connected with electric lines 40.

The insulating housing 21 of the modularized switch connector 20 is in the shape of a shovel and is formed integrally, this shape is given in matching with the shape and contour surrounding the first and second electrically connecting pins 11, 12 as well as the grounding electrically connecting pin 13 of the micro switch 10. The insulating housing 21 has an upper portion 211 and a lower forwardly protruding portion 212.

Figure 5:
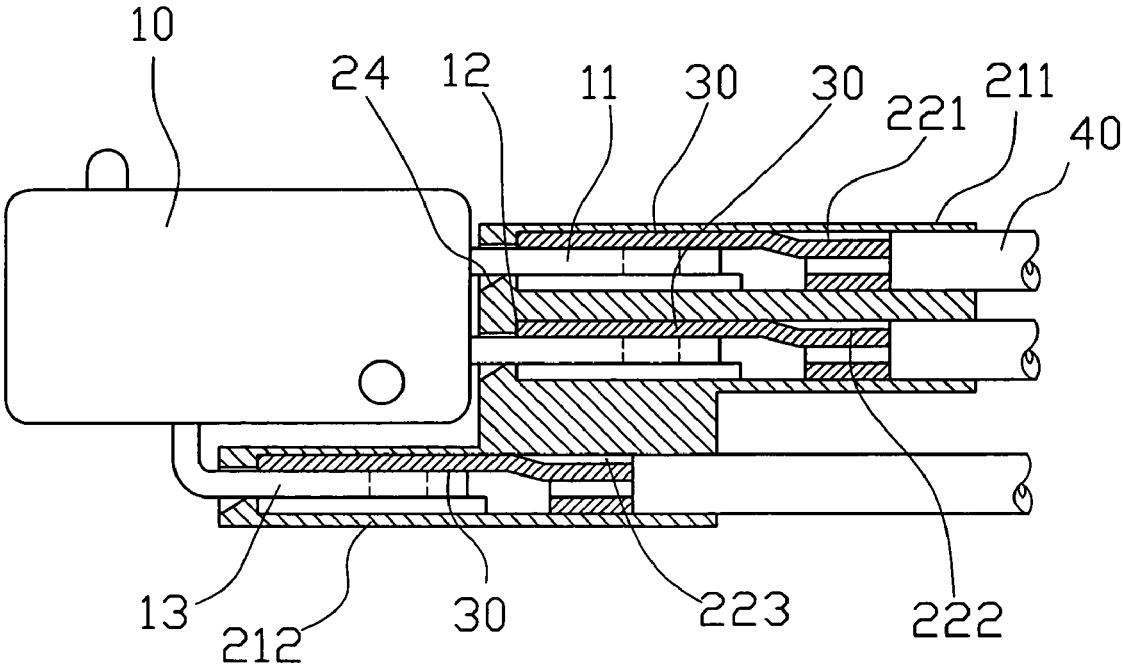
FIG. 5 is a sectional plane view taken from FIG. 2.

Referring to FIG. 5, the upper portion 211 is formed thereon a first and a second through hole 221, 222, while the lower forwardly protruding portion 212 has a third through hole 223. The rear end of each of the through holes 221, 222 and 223 allows inserting of an electrically conducting jack 30 with a "U" shaped section therein to form an integral switch connector. And the front end of each through hole 221 (222 or 223) allows inserting of a corresponding electrically connecting pin 11 (12 or 13) of the micro switch 10 therein; so that the first and the second electrically connecting pins 11, 12 of the micro switch 10 can be connected with two electrically conducting jacks 30 in the first and the second through holes 221, 222, while the grounding electrically connecting pin 13 can be connected with the electrically conducting jack 30 in the third through hole 223.

Thereby when in assembling, all the electrically conducting jacks 30 can be inserted into the insulating housing 21 from the rear ends of the through holes 221, 222 and 223 to form the switch connector loaded with electricity through the electric lines 40 connected with the electrically conducting jacks 30. Then the electrically connecting pins 11, 12 and 13 of the micro switch 10 are inserted into the through holes 221, 222 and 223 from the front end of the insulating housing 21, thus electrically connecting of the micro switch 10 can be completed. Evidently, the modularized switch connector of the present invention can be completed by only one time operation, it is not necessary to make electric line connection one line by one line, time and energy can be reduced; more importantly, the insulating housing 21 is shaped in matching with the shape and contour surrounding the micro switch 10 and thus endues us with a sense of direction, thereby in assembling, there will be no problem of wrongly inserting.

Referring to FIG. 5, in order to render the switch connector of the present invention easier to connect by insertion with the electrically connecting pins 11, 12 and 13 of the micro switch 10, each of the through holes 221, 222 and 223 of the insulating housing 21 is provided at a corner of the front opening end thereof with a bevel guiding slope 24 inclining outwards and downwards in order that the sheet shaped electrically connecting pins 11, 12 and 13 of the micro switch 10 can slide into the through holes 221, 222 and 223 of the insulating housing 21 to contact the electrically conducting jacks 30.

Figure 4:
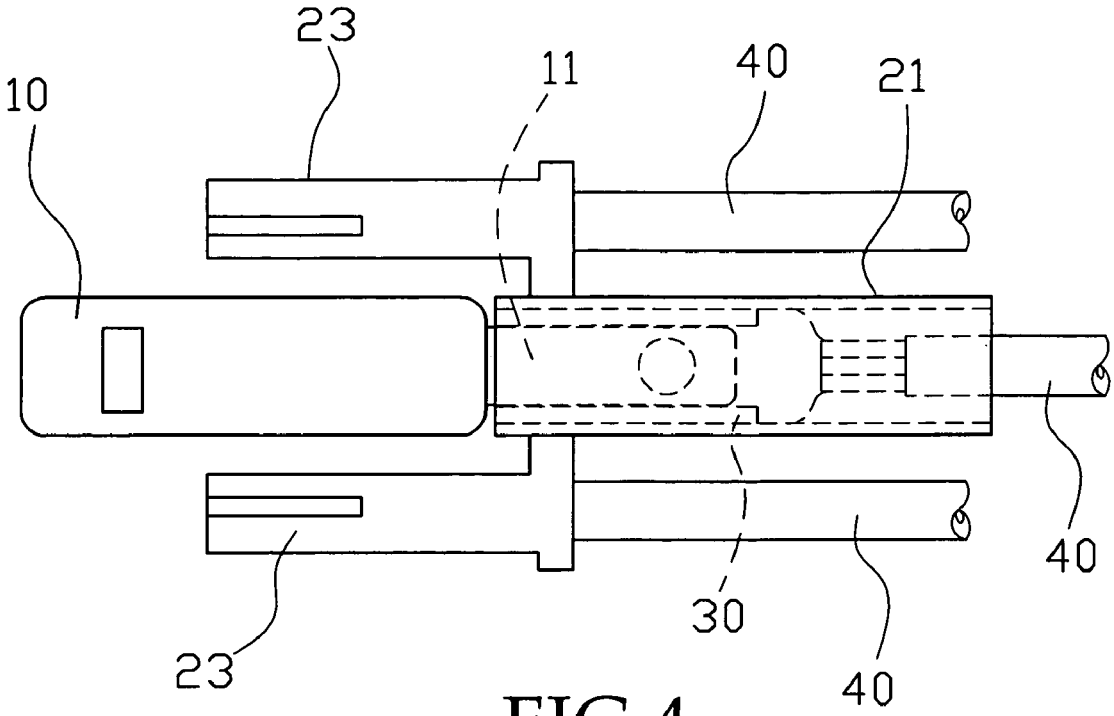
FIG. 4 is a top view taken from FIG. 2.

Further in reference to FIGS. 3 and 4, the shovel shaped insulating housing 21 has two seats 23 with holes 231 integrally connected therewith and provided laterally thereof, the holes 231 in the seats 23 can be mounted respectively with two electrically conducting jacks 30 for in turn connecting with indicating lamps.

The main technical point of the present invention is to modularize the switch connector to make it the form of a unitary socket for the purpose of fast connecting the micro switch 10. The present invention is not limited to what is depicted in the drawings; it will be apparent to those skilled in this art that various modifications or changes can be made to the elements of the present invention without departing from the spirit and scope of this invention. Accordingly, all such modifications and changes also fall within the scope of the appended claims.

Having now particularly described and ascertained the novelty and improvement of the modularized switch connector of the present invention, what we claim will be declared in the claims followed.

The invention claimed is:

1. A modularized switch connector, said connector is used for electrically connecting to a micro switch, said micro switch has three electrically connecting pins extending out of it, wherein a first electrically connecting pin and a second electrically connecting pin are provided at one end of said micro switch and parallel with each other, a third grounding electrically connecting pin is extended out of a bottom of said micro switch; said switch connector comprises:

a shovel shaped insulating housing formed integrally, said housing is shaped in matching with the shape and contour surrounding said first and said second electrically connecting pins as well as said grounding electrically connecting pin of a micro switch; said insulating housing is formed thereon a first and a second through hole, and is formed on its lower forwardly protruding portion a third through hole; and a plurality of electrically conducting jacks each with a "U" shaped section fittingly covering said electrically connecting pins of said micro switch for electrically conducting, rear ends of said electrically conducting jacks are connected with electric lines;

a rear end of each of said through holes allows inserting therein of a corresponding one of said electrically conducting jacks to form an integral switch connector, while a front end of each of said through holes allows inserting of a corresponding one of said electrically connecting pins of said micro switch; so that said first and said second electrically connecting pins of said micro switch are connected with corresponding ones of said electrically conducting jacks in said first and said second through holes, while said grounding electrically connecting pin is connected with the rest of said electrically conducting jacks in said third through hole.

2. The modularized switch connector as claimed in claim 1, wherein said insulating housing has two seats with holes integrally connected therewith and provided laterally thereof, said holes in said seats are mounted respectively with two electrically conducting jacks for connecting with indicating lamps.

3. The modularized switch connector as claimed in claim 1, wherein said insulating housing is provided at a corner of a front opening end thereof with a bevel guiding slope inclining outwards and downwards.

* * * * *